US010151152B2

(12) United States Patent
Wight et al.

(10) Patent No.: US 10,151,152 B2
(45) Date of Patent: Dec. 11, 2018

(54) PERFORATING GUN CONNECTORS

(71) Applicant: Halliburton Energy Services, Inc., Houston, TX (US)

(72) Inventors: James Wight, Mansfield, TX (US); John P. Rodgers, Southlake, TX (US); Timothy S. Glenn, Dracut, MA (US); Marco Serra, Winterthur (CH)

(73) Assignee: Halliburton Energy Services, Inc., Houston, TX (US)

( * ) Notice: Subject to any disclaimer, the term of this patent is extended or adjusted under 35 U.S.C. 154(b) by 209 days.

(21) Appl. No.: 15/116,303

(22) PCT Filed: Apr. 8, 2014

(86) PCT No.: PCT/US2014/033264
§ 371 (c)(1),
(2) Date: Aug. 3, 2016

(87) PCT Pub. No.: WO2015/156771
PCT Pub. Date: Oct. 15, 2015

(65) Prior Publication Data
US 2017/0009532 A1 Jan. 12, 2017

(51) Int. Cl.
*E21B 17/02* (2006.01)
*E21B 43/116* (2006.01)
*E21B 43/119* (2006.01)
*E21B 43/117* (2006.01)

(52) U.S. Cl.
CPC ..... *E21B 17/02* (2013.01); *E21B 43/116* (2013.01); *E21B 43/117* (2013.01); *E21B 43/119* (2013.01)

(58) Field of Classification Search
CPC ..... E21B 43/116; E21B 29/02; E21B 17/02; E21B 17/042; E21B 17/04
USPC ..... 102/309, 307, 310; 89/1.15
See application file for complete search history.

(56) References Cited

U.S. PATENT DOCUMENTS 5,823,266 A * 10/1998 Burleson ..... E21B 17/06 166/380
7,013,977 B2 * 3/2006 Nordaas ..... E21B 17/042 166/297
7,431,347 B2 * 10/2008 Ernst ..... E21B 17/042 285/333
7,861,785 B2 * 1/2011 Frazier ..... E21B 43/11 166/299

(Continued)

FOREIGN PATENT DOCUMENTS

EP 0931907 A2 7/1999

OTHER PUBLICATIONS

International Search Report and Written Opinion for PCT/US2014/033264 dated Jan. 8, 2015.

*Primary Examiner* — Kenneth L Thompson
(74) *Attorney, Agent, or Firm* — McGuireWoods LLP

(57) ABSTRACT

A perforating gun string may include a first perforating gun; a second perforating gun axially offset from the first perforating gun; a connector configured to interpose and couple the first and second perforating guns; and a detonation cord that passes axially through a central bore of the connector; and is connected to the first and second perforating guns. In some instances, the connector may have a body with an inner surface that defines the central bore, wherein the body has a ratio of an average diameter of the outer surface to an average diameter of the inner surface of about 1.2 to about 4.

20 Claims, 4 Drawing Sheets

(56) References Cited

U.S. PATENT DOCUMENTS

| | | | | |
|---|---|---|---|---|
| 8,584,519 | B2 | 11/2013 | Maida et al. | |
| 8,844,625 | B2 * | 9/2014 | Mhaskar | E21B 17/02 166/242.6 |
| 2004/0216866 | A1 | 11/2004 | Barlow et al. | |
| 2006/0237190 | A1 * | 10/2006 | Snider | E21B 43/263 166/250.07 |
| 2008/0210425 | A1 | 9/2008 | Myers et al. | |
| 2011/0094745 | A1 | 4/2011 | Frazier et al. | |
| 2012/0014211 | A1 | 1/2012 | Maida, Jr. et al. | |
| 2012/0241170 | A1 | 9/2012 | Hales et al. | |
| 2017/0211363 | A1 * | 7/2017 | Bradley | F42B 3/08 |

* cited by examiner

PERFORATING GUN CONNECTORS

BACKGROUND

The embodiments described herein relate to perforating gun connectors and, more particularly, to improved connectors used to couple perforating guns.

After drilling the various sections of a subterranean wellbore that traverses a hydrocarbon-bearing formation, individual lengths of relatively large diameter metal tubulars are typically secured together to form a casing string that is positioned within the wellbore. This casing string increases the integrity of the wellbore and provides a centralized path for producing fluids extracted from intervals in the formation to the surface. Conventionally, the casing string is cemented within the wellbore. To produce fluids into the casing string, hydraulic openings or perforations extending into the surrounding subterranean formation must be made through the casing string and the cement.

Typically, these perforations are created by detonating a series of shaped charges that are disposed within the casing string and positioned adjacent to the formation. Specifically, one or more perforating guns are loaded with shaped charges. Multiple perforating guns can be coupled with connectors to form a perforating gun string that is lowered into the cased wellbore on an appropriate conveyance. Once the perforating gun string is properly positioned in the wellbore such that the shaped charges are disposed adjacent the formation to be perforated, a firing head is actuated and the shaped charges detonate in a predetermined fashion, thereby creating the desired hydraulic openings into the casing string. The perforating gun string may then be retrieved to the surface.

BRIEF DESCRIPTION OF THE DRAWINGS

The following figures are included to illustrate certain aspects of the embodiments and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The embodiments described herein relate to perforating gun connectors and, more particularly, to improved connectors used to couple perforating guns.

In recent practice, connectors used for axially coupling two perforating guns are typically substantially solid metal cylinders with appropriate connections or fastening means at each end and a small diameter passageway (e.g., less than about 10 mm) centrally defined therein for running a detonation cord therethrough. When the shaped charges in the perforating guns are detonated, the pressure waves impact the top and bottom faces at the ends of the gun connectors and apply a load to the connector, which can result in detrimental structural damage to a perforating gun. In some instances, this structural damage can cause the perforating string to buckle or deform or, in a worst-case scenario, to separate and frustrate the perforating operation altogether. The damage can also cause the perforating gun string, or portions thereof, to become lodged within the wellbore, which may require a time consuming and expensive fishing operation to capture and retrieve the stuck perforating gun string.

The embodiments disclosed herein describe improved connectors for coupling two perforating guns that exhibit a large diameter central bore (e.g., 10 mm or greater), which reduces the size of the top and bottom faces of the connector. The larger diameter bore may prove advantageous in providing a larger pathway for the pressure waves generated during detonation to traverse, thereby mitigating or eliminating altogether any structural damage that may occur to the perforating string.

The perforating gun strings described herein may, in some embodiments, be positioned within and/or retrieved from a wellbore with a positioning tool like a rigid tool string, a pipe string, a coiled tube, a cable, or a wireline.

Figure 1:
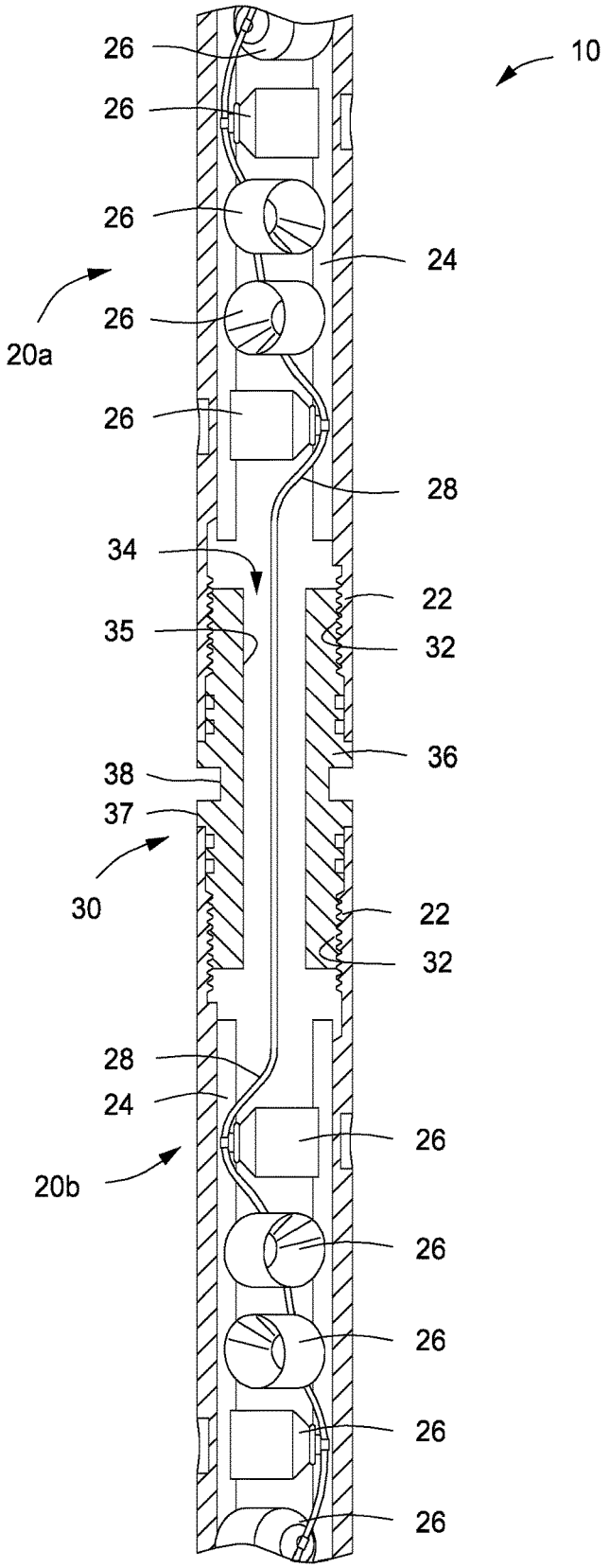
FIG. 1 provides a cross-sectional illustration of a portion of a perforating gun string where two perforating guns are coupled with a connector according to at least some embodiments described herein.

FIG. 1 provides a cross-sectional illustration of a portion of an exemplary perforating gun string 10, according to at least some embodiments described herein. As illustrated, the perforating gun string 10 may include at least two perforating guns, shown as perforating guns 20*a* and 20*b*, that are axially coupled using a connector 30. Each perforating gun 20*a,b* includes a female or box end connection 22 that may be threadably coupled to opposing ends of the connector 30 that exhibit corresponding male or pin connections 32. In some applications, this type of connection or connector is referred to as a tandem connector. Each perforating gun 20*a,b* may include a frame 24 for assembling one or more shaped charges 26 and interconnecting the shaped charges 26 with a common detonation cord 28.

The connector 30 may define or otherwise provide an elongate body 36 having a central bore 34 that extends longitudinally therethrough and defining an inner surface 35. An annular groove 38 may be defined in an outer surface 37 of the body 36. The groove 38 may be useful in providing a location for lifting or otherwise manipulating the connector 30, the perforating gun string 10, or a portion thereof.

In some instances, the body 36 of the connector 30 may exhibit a ratio of an average outer diameter (i.e., the average diameter at the outer surface 37) to an average inner diameter (i.e., the average diameter at the inner surface 35) of about 1.2 to about 4. Although one embodiment of connector 30 that incorporates elements of the present disclosure is shown, other connector embodiments are possible. For example, the connector 30 may be formed by two or more pieces. In another example, the connector 30 may have different connections (e.g., two female connections or a male and female connection) to correspond to the connections of the axially adjacent perforating guns 20*a,b* to be coupled.

Figure 2:
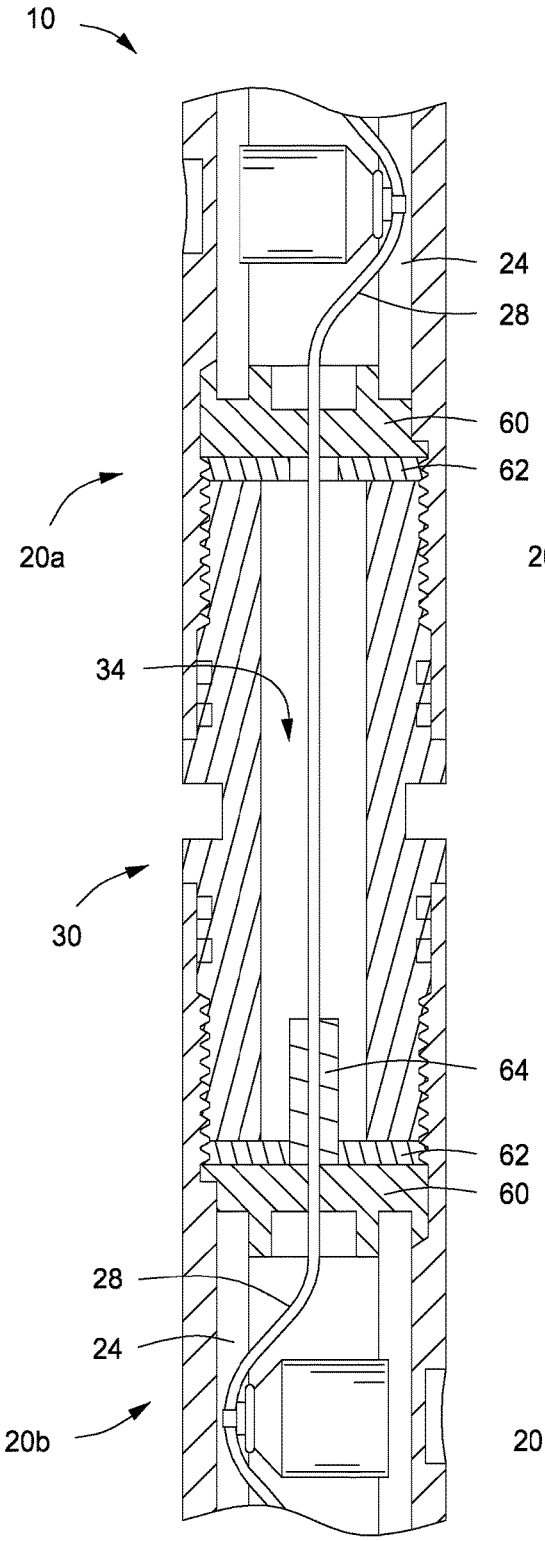
FIG. 2 provides a cross-sectional illustration of a portion of a perforating gun string where two perforating guns are coupled with a connector according to at least some embodiments described herein.

FIG. 2, with continued reference to FIG. 1, provides a cross-sectional illustration of a portion of an exemplary perforating gun string 10, according to at least some embodiments described herein. As illustrated, the perforating gun string 10 may include at least two perforating guns, shown as perforating guns 20*a* and 20*b*, that are axially coupled using a connector 30 having a central bore 34. The top and bottom of FIG. 2 illustrate two distinct embodiments that may be implemented. For instance, as illustrated at the top of the central bore 34 in FIG. 2, an alignment fixture 60 and a cushion 62 may be disposed between the frame 24 of the upper perforating gun 20*a* and the central bore 34 of the connector 30 (e.g., for aligning and securing the frame 24 in the perforating gun 20*a*). The alignment fixture 60 and associated cushion 62 may be configured to allow the detonation cord 28 to pass therethrough.

Moreover, as illustrated at the bottom of the central bore 34 in FIG. 2, an alignment fixture 60 and a cushion 62 may be disposed between the frame 24 of the lower perforating gun 20*b* and the central bore 34 of the connector 30 (e.g., for aligning and securing the frame 24 in the perforating gun 20*b*). The connector 30 may further include a tubing 64 that extends from the cushion 602 or is otherwise disposed therethrough and extends axially into the central bore 34. The tubing 64 may be configured to receive the detonation cord 28 and allow it to pass therethrough, thereby providing protection for the detonation cord 28 during manipulation of the perforating gun string 10 or portions thereof and during perforation operations.

In some instances (not shown), the tubing 64 may extend axially into the alignment fixture 60. In some instances (not shown), the tubing 64 may extend the length of the central bore 34 between the cushions 62 (and optionally the alignment fixtures 60) at either end of the connector 30. In some instances (not shown), the tubing 64 may be secured within the perforating gun string 10 (e.g., to the connector 30 or either of the perforating guns 20*a,b*) with spokes, tethers, plates, washers, any hybrid thereof, and the like.

Figure 3:
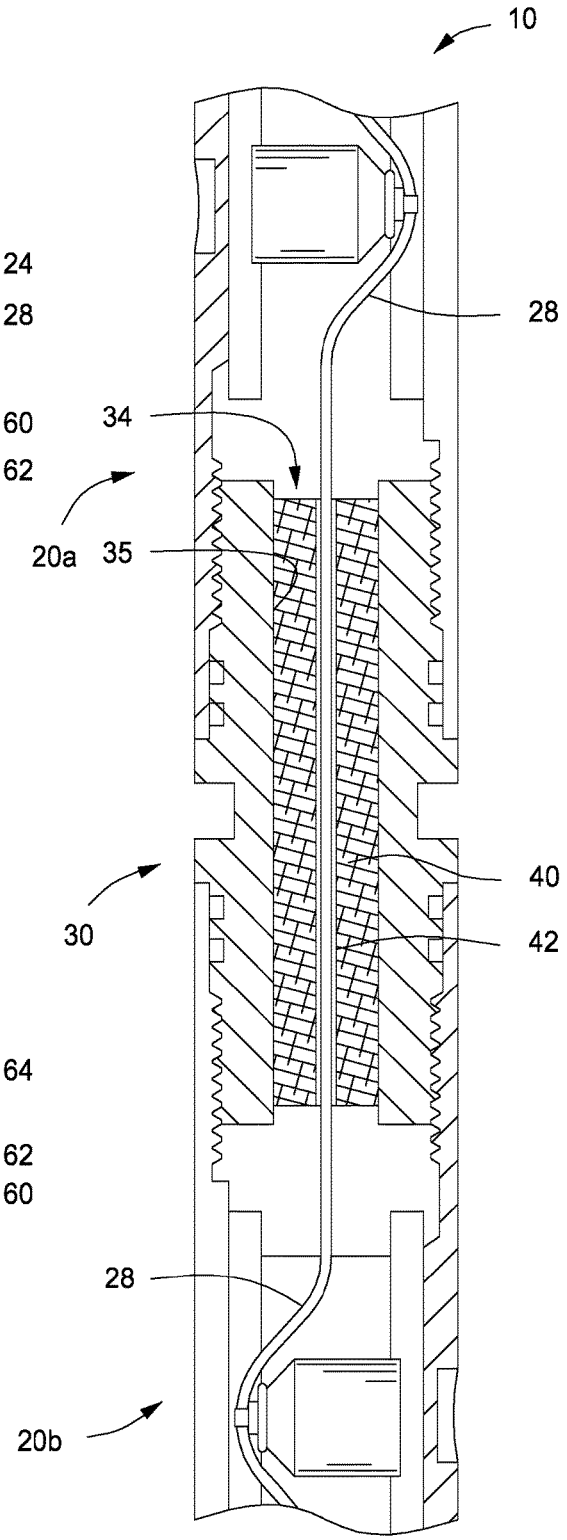
FIG. 3 provides a cross-sectional illustration of a portion of a perforating gun string where two perforating guns are coupled with a connector according to at least some embodiments described herein.

FIG. 3, with continued reference to FIG. 1, provides a cross-sectional illustration of a portion of an exemplary perforating gun string 10, according to at least some embodiments described herein. As illustrated, the perforating gun string 10 may include at least two perforating guns, shown as perforating guns 20*a* and 20*b*, that are axially coupled using a connector 30 having a central bore 34. In some embodiments, a plug 40 may be secured or otherwise contained within the central bore 34 and may define a central passageway 42 therethrough that may be configured to accommodate the detonation cord 28. The detonation cord 28 may extend through the plug 40 in order to connect the axially adjacent perforating guns 20*a,b* such that successive detonation of the guns 20*a,b* may be achieved.

Arranging, placing, or otherwise securing of the plug 40 within the central bore 34 may be achieved by many techniques. In some instances, for example, the plug 40 may be formed of a resilient material and oversized relative to central bore 34 such that, when placed in central bore 34, the resilient material is secured to the inner surface 35 via an interference fit. One of skill in the art will readily recognize other components, devices, or configurations that may equally be used or implemented to contain or otherwise secure the plug 40 in the central bore 34 of the connector 30. In some embodiments, for example, the plug 40 may be threaded into the central bore 34. In other embodiments, the plug 40 may be secured within the central bore 34 with adhesives or using one or more welding or brazing techniques. In yet other embodiments, the plug 40 may be secured within the central bore 34 using one or more mechanical fasteners such as, but not limited to, screws, bolts, pins, snap rings, c-rings, and any combination thereof.

Figure 4:
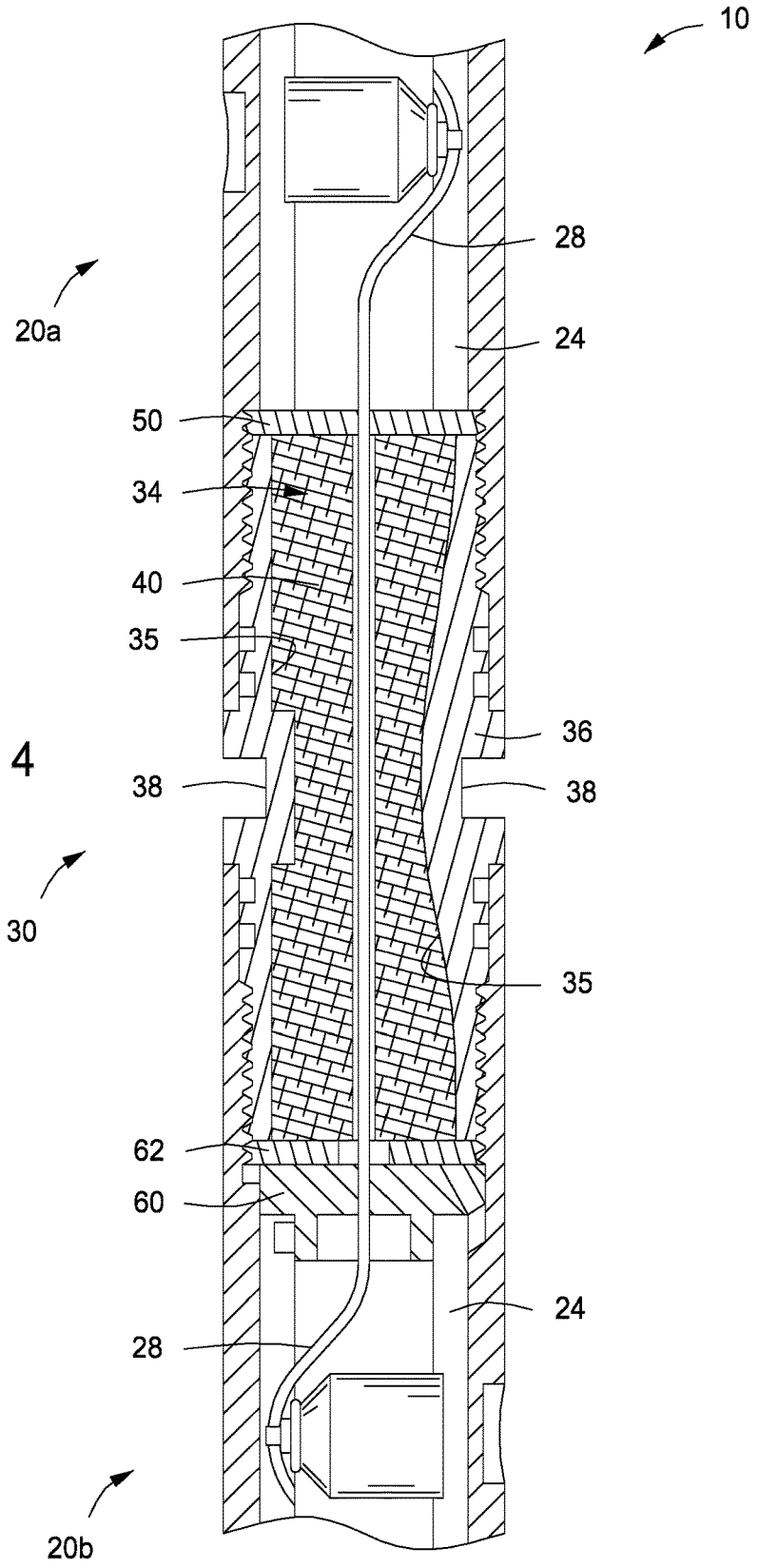
FIG. 4 provides a cross-sectional illustration of a portion of a perforating gun string where two perforating guns are coupled with a connector according to at least some embodiments described herein.

FIG. 4, with continued reference to FIG. 1, provides a cross-sectional illustration of a portion of an exemplary perforating gun string 10, according to at least some embodiments described herein. The top and bottom of FIG. 4 illustrate two distinct embodiments that may be implemented to physically contain or otherwise secure the plug 40 within the central bore 34. For instance, as illustrated at the top of the central bore 34 in FIG. 4, a washer 50 may be disposed between the frame 24 of the upper perforating gun 20*a* and the central bore 34 of the connector 30. The washer 50 may be annular and otherwise configured to allow the detonation cord 28 to pass therethrough and into the plug 40.

Moreover, as illustrated at the bottom of the central bore 34 in FIG. 4, an alignment fixture 60 and a cushion 62 may be disposed between the frame 24 of the lower perforating gun 20*b* and the central bore 34 of the connector 30 (e.g., for aligning and securing the frame 24 in the perforating gun 20*b*). The alignment fixture 60 and associated cushion 62 may be configured to allow the detonation cord 28 to pass therethrough from the plug 40 and into lower portions of the lower perforating gun 20*b*.

FIG. 4 further illustrates two distinct embodiments for varying a diameter of the central bore 34. More particularly, the right side of the body 36 and corresponding central bore 34 depict one embodiment of varying the diameter of the central bore 34, and the left right side of the body 36 and the central bore 34 depict another embodiment of varying the diameter of the central bore 34. The diameter of the central bore 34 and thickness of the body 36 may be varied to provide the connector 30 with a predetermined collapse rating and tensile load rating suitable for application in the perforating gun string 10.

In some instances, as depicted on the right side of FIG. 4, the body 36 may protrude into the central bore 34 at or near the groove 38. For example, the body 36 may be configured to vary in thickness and otherwise protrude radially into the central bore 34 with an inner surface 35 that is tapered. In other instances, such as is depicted on the left side of FIG. 4, the body 36 may have a substantially constant thickness along its axial length but protrude into the central bore 34 as a step in the inner surface 35 at or near the groove 38. One of skill in the art will readily recognize other configurations or designs for the body 36 to protrude into the central bore 34 (e.g., an inner surface 35 that includes one or more beveled portions or chamfers). For example, the inner surface 35 may be designed to include bevels at the ends of the body 36.

In some embodiments, the plug 40 may be formed of a compressible material (reversibly or irreversibly compressible) suitable for protecting the detonation cord 28 during manipulation of the perforating gun string 10 or portions thereof and during perforation operations. In some preferred embodiments, the material of the plug 40 may have little to no resistance to the forces associated with detonation of the shaped charges 26. Further, in some embodiments, the material of the plug 40 may not need to have sufficient strength for the integrity of the plug 40 to be preserved after experiencing the forces associated with detonation of the shaped charges 26. In some instances, the plug 40 or portions thereof may be removable from the connector 30 after a perforating operation, such that the connector 30 may be reused in another perforating gun string 10.

Examples of materials suitable for use in forming the plug 40 described herein may include, but are not limited to, metal foams, metal honeycombs, silicone, natural rubber, acrylate butadiene rubber, polyacrylate rubber, isoprene rubber, chloroprene rubber, butyl rubber, brominated butyl rubber, chlorinated butyl rubber, chlorinated polyethylene, neoprene rubber, styrene butadiene copolymer rubber, hydrogenated nitrile butadiene rubber, sulphonated polyethylene, ethylene acrylate rubber, epichlorohydrin ethylene oxide copolymer, ethylene propylene rubber, ethylene propylene diene terpolymer rubber, ethylene vinyl acetate copolymer, fluorosilicone rubber, silicone rubber, poly-2,2, 1-bicycloheptene (polynorborneane), alkylstyrene, crosslinked substituted vinyl acrylate copolymer, nitrile rubber (butadiene acrylonitrile copolymer), hydrogenated nitrile rubber, fluororubber, fluoroelastomer (e.g., VITON® available from DuPont and AFLAS™ available from Parker Hannifin Corp.), polytetrafluoroethylene (e.g., TEFLON® available from DuPont), perfluoro rubber, perfluoroelastomer (e.g., KALREZ® available from DuPont), tetrafluoroethylene/propylene, starch polyacrylate acid graft copolymer, polyvinyl alcohol cyclic acid anhydride graft copolymer, isobutylene maleic anhydride, acrylic acid type polymer, vinylacetate-acrylate copolymer, polyethylene oxide polymer, carboxymethyl cellulose polymer, starch-polyacrylonitrile graft copolymer, polymethacrylate, polyacrylamide, non-soluble acrylic polymer, polyamide-imide (e.g., TORLON® available from Solvay Plastics), polybenzimidazole (e.g., CELAZOLE® available from Aetna Plastics), epoxy, nylon, phenolic plastics, polybutylene terephthalate, thermoset polyesters, polyetherimide, polyethersulfone, polyphenylene sulfide, polyphthalamide, polysulfone, vinyl esters, polyetheretherketone, partially aromatic nylon, polyamide, polyether ketone, and the like, and any combination thereof. In some embodiments, the material for use in forming the plug 40 described herein may be reinforced with particles, fibers, or both.

In some instances, the materials forming the plug 40 may be in any suitable form (e.g., a solid, a solid foam, a woven fiber material, a nonwoven fiber structure, a honeycomb structure, and the like, and any combination thereof). In some embodiments, the plug 40 may be formed of a combination of materials differentiated by composition, form, or both.

Figure 5:
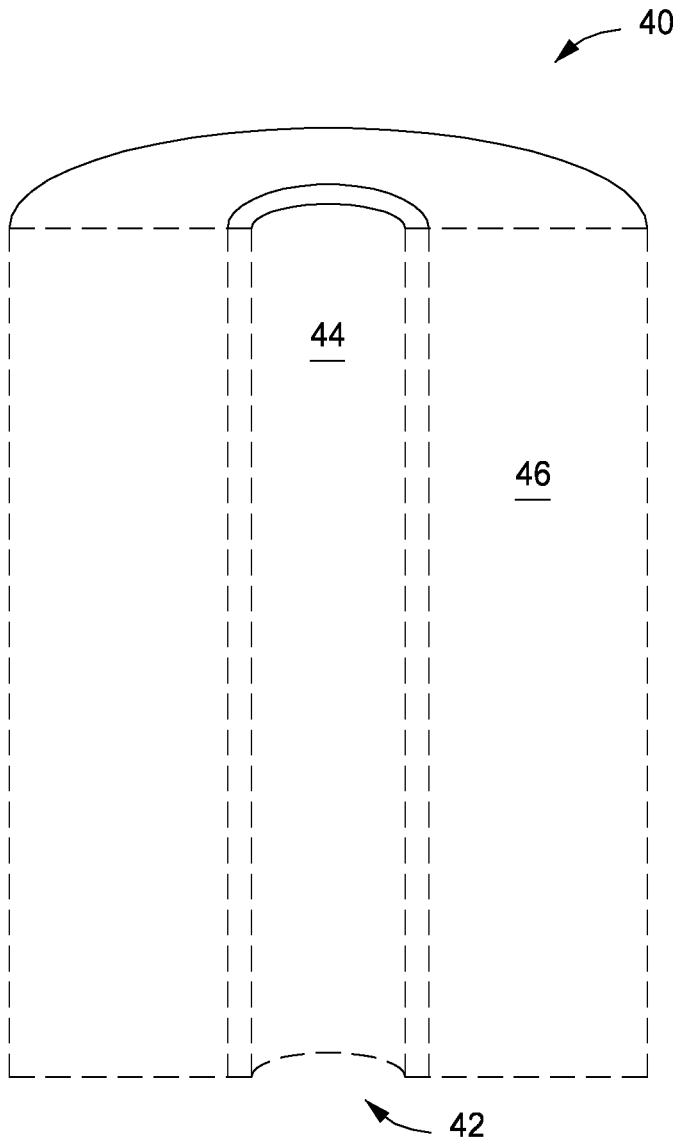
FIG. 5 provides a cross-sectional illustration of a plug having an inner layer and an outer layer according to at least some embodiments described herein.

FIG. 5 provides a cross-sectional illustration of an exemplary plug 40 having an inner layer 44 and an outer layer 46 according to at least some embodiments described herein. In some instances, the inner layer 44 may form the central passageway 42, and the outer layer 46 may be disposed about the inner layer 44 and otherwise secured to the inner surface 35 of the body 36. The inner layer 44 may, in some instances, be more rigid than the outer layer 46 so as to provide additional protection for a detonation cord during transportation and manipulation of the perforating gun string 10 or portions thereof.

Some embodiments may involve implementing the perforating gun strings described herein. For example, a perforating gun string may be positioned along a wellbore penetrating a subterranean formation. Then, the shape charges may be detonated, thereby generating pressure waves. At least some of the pressure waves may be allowed to pass through the central bore and optionally impinge a plug disposed therein when utilized. As described above, the size of the central bore (optionally in combination with a plug) may advantageously reduce the load applied to the connector and mitigate structural damage to the perforating gun or string.

Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related, and other constraints, which vary by implementation and from time to time. While a developer's efforts might be time-consuming, such efforts would be, nevertheless, a routine undertaking for those of ordinary skill the art and having benefit of this disclosure.

Embodiments disclosed herein include:

A. a perforating gun string that includes a first perforating gun; a second perforating gun axially offset from the first perforating gun; a connector configured to interpose and couple the first and second perforating guns, the connector having a body with an inner surface that defines a central bore, and the body having a ratio of an average diameter of the outer surface to an average diameter of the inner surface of about 1.2 to about 4; and a detonation cord that passes axially through the central bore and is connected to the first and second perforating guns; and B. detonating one or more first shaped charges contained in a first perforating gun positioned within a wellbore penetrating a subterranean formation; detonating one or more second shaped charges in a second perforating gun coupled to the first perforating gun by a connector having a body with an outer surface, an inner surface, and a ratio of an average diameter of the outer surface to an average diameter of the inner surface of about 1.2 to about 4; and receiving at least some pressure waves generated by detonating the one or more first and second shaped charges within a central bore of the connector defined by the inner surface.

Each of embodiments A and B may have one or more of the following additional elements in any combination: Element 1: wherein a diameter of the central bore varies along an axial length of the connector; Element 2: wherein the inner surface is tapered; Element 3: wherein the inner surface is beveled; Element 4: wherein the inner surface includes a step; Element 5: wherein the connector comprises two or more pieces; Element 6: wherein the first and second perforating guns each comprises a frame with one or more shaped charges arranged thereon; Element 7: the perforating gun string of Element 6 further including a washer disposed between the central bore and the frame of at least one of the first or second perforating guns; Element 8: the perforating gun string of Element 6 further including an alignment fixture and a cushion disposed between the central bore and the frame of at least one of the first or second perforating guns; Element 9: the perforating gun string further including a tubing extending axially through at least a portion of the central bore, wherein the detonation cord passes axially through the tubing; Element 10: Element 9 wherein the tubing is secured to one of the connector or the first or second perforating guns with at least one of spokes, tethers, a plate, a washer, or any hybrid thereof; Element 11: the perforating gun string further including a plug disposed within at least a portion of the central bore, the plug having a central passageway defined therethrough for receipt of the detonation; Element 12: Element 11 wherein the plug comprises a resilient material configured to form an interference fit against the inner surface; Element 13: Element 11 wherein the plug is formed at least in part by a material that comprises at least one of: a metal foam, a metal honeycomb, silicone, natural rubber, acrylate butadiene rubber, polyacrylate rubber, isoprene rubber, chloroprene rubber, butyl rubber, brominated butyl rubber, chlorinated butyl rubber, chlorinated polyethylene, neoprene rubber, styrene butadiene copolymer rubber, hydrogenated nitrile butadiene rubber, sulphonated polyethylene, ethylene acrylate rubber, epichlorohydrin ethylene oxide copolymer, ethylene propylene rubber, ethylene propylene diene terpolymer rubber, ethylene vinyl acetate copolymer, fluorosilicone rubber, silicone rubber, poly-2,2, 1-bicycloheptene (polynorborneane), alkylstyrene, crosslinked substituted vinyl acrylate copolymer, nitrile rubber (butadiene acrylonitrile copolymer), hydrogenated nitrile rubber, fluororubber, fluoroelastomer, polytetrafluoroethylene, perfluoro rubber, perfluoroelastomer, tetrafluoroethylene/propylene, starch polyacrylate acid graft copolymer, polyvinyl alcohol cyclic acid anhydride graft copolymer, isobutylene maleic anhydride, acrylic acid type polymer, vinylacetate-acrylate copolymer, polyethylene oxide polymer, carboxymethyl cellulose polymer, starch-polyacrylonitrile graft copolymer, polymethacrylate, polyacrylamide, non-soluble acrylic polymer, polyamide-imide, polybenzimidazole, epoxy, nylon, phenolic plastics, polybutylene terephthalate, thermoset polyesters, polyetherimide, polyethersulfone, polyphenylene sulfide, polyphthalamide, polysulfone, vinyl esters, polyetheretherketone, partially aromatic nylon, polyamide, polyether ketone, or any combination thereof; Element 14: Element 11 wherein the plug comprises a material in at least one form of: a solid, a solid foam, a woven fiber material, a nonwoven fiber structure, a honeycomb structure, and any combination thereof; Element 15: Element 11 wherein the plug comprises an inner layer that forms the central passageway and an outer layer disposed about the inner layer; and Element 16: Element 15 wherein the inner layer is more rigid than the outer layer.

By way of non-limiting example, exemplary combinations applicable to A and B may include: at least two of Elements 2-4 in combination and optionally in combination with Element 5; one of Elements 2-4 in combination with Element 5; at least one of Elements 6-8 in combination with Element 9 and optionally Element 10; at least one of Elements 1-5 in combination with Element 9 and optionally Element 10; at least one of Elements 1-8 in combination with Element 11 and optionally at least one of Elements 12-16; at least one of Elements 12-14 in combination with Element 11 and Element 15 and optionally in combination with Element 16; Element 1 in combination with any of the foregoing; and Element 1 in combination with one of Element 2-16.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. As used herein, the term "coupled" and its variations include both direct and indirect couplings between two elements.

The invention claimed is:

1. A perforating gun string comprising:

a first perforating gun;

a second perforating gun axially offset from the first perforating gun;

a connector positioned between and coupled to the first and second perforating guns, the connector having a body with an outer surface and an inner surface that defines a central bore, and the body having a ratio of an average diameter of the outer surface to an average diameter of the inner surface of about 1.2 to about 4; and a detonation cord that passes axially through the central bore and is connected to the first and second perforating guns.

2. The perforating gun string of claim 1, wherein a diameter of the central bore varies along an axial length of the connector.

3. The perforating gun string of claim 1, wherein the inner surface is tapered.

4. The perforating gun string of claim 1, wherein the connector comprises two or more pieces.

5. The perforating gun string of claim 1, wherein the first and second perforating guns each comprise a frame with one or more shaped charges arranged thereon.

6. The perforating gun string of claim 5 further comprising a washer disposed between the central bore and the frame of at least one of the first or second perforating guns.

7. The perforating gun string of claim 5 further comprising an alignment fixture and a cushion disposed between the central bore and the frame of at least one of the first or second perforating guns.

8. The perforating gun string of claim 1 further comprising a tubing extending axially through at least a portion of the central bore, wherein the detonation cord passes axially through the tubing.

9. The perforating gun string of claim 8, wherein the tubing is secured to one of the connector or the first or second perforating guns with at least one of spokes, tethers, a plate, a washer, or any hybrid thereof.

10. The perforating gun string of claim 1 further comprising a plug disposed within at least a portion of the central bore, the plug having a central passageway defined therethrough for receipt of the detonation cord.

11. The perforating gun string of claim 10, wherein the plug comprises a resilient material configured to form an interference fit against the inner surface.

12. The perforating gun string of claim 10, wherein the plug is formed at least in part by a material that comprises at least one of: a metal foam, a metal honeycomb, silicone, natural rubber, acrylate butadiene rubber, polyacrylate rubber, isoprene rubber, chloroprene rubber, butyl rubber, brominated butyl rubber, chlorinated butyl rubber, chlorinated polyethylene, neoprene rubber, styrene butadiene copolymer rubber, hydrogenated nitrile butadiene rubber, sulphonated polyethylene, ethylene acrylate rubber, epichlorohydrin ethylene oxide copolymer, ethylene propylene rubber, ethylene propylene diene terpolymer rubber, ethylene vinyl acetate copolymer, fluorosilicone rubber, silicone rubber, poly-2,2,1-bicycloheptene (polynorborneane), alkylstyrene, cross-linked substituted vinyl acrylate copolymer, nitrile rubber (butadiene acrylonitrile copolymer), hydrogenated nitrile rubber, fluororubber, fluoroelastomer, polytetrafluoroethylene, perfluoro rubber, perfluoroelastomer, tetrafluoroethylene/propylene, starch polyacrylate acid graft copolymer, polyvinyl alcohol cyclic acid anhydride graft copolymer, isobutylene maleic anhydride, acrylic acid type polymer, vinylacetate-acrylate copolymer, polyethylene oxide polymer, carboxymethyl cellulose polymer, starch-polyacrylonitrile graft copolymer, polymethacrylate, polyacrylamide, non-soluble acrylic polymer, polyamide-imide, polybenzimidazole, epoxy, nylon, phenolic plastics, polybutylene terephthalate, thermoset polyesters, polyetherimide, polyethersulfone, polyphenylene sulfide, polyphthalamide, polysulfone, vinyl esters, polyetheretherketone, partially aromatic nylon, polyamide, polyether ketone, or any combination thereof.

13. The perforating gun string of claim 10, wherein the plug comprises a material in at least one form of: a solid, a solid foam, a woven fiber material, a nonwoven fiber structure, a honeycomb structure, and any combination thereof.

14. The perforating gun string of claim 10, wherein the plug comprises an inner layer that forms the central passageway and an outer layer disposed about the inner layer.

15. The perforating gun string of claim 14, wherein the inner layer is more rigid than the outer layer.

16. A method comprising:

detonating one or more first shaped charges contained in a first perforating gun positioned within a wellbore penetrating a subterranean formation;

detonating one or more second shaped charges in a second perforating gun coupled to the first perforating gun by a connector having a body with an outer surface, an inner surface, and a ratio of an average diameter of the outer surface to an average diameter of the inner surface of about 1.2 to about 4; and receiving at least some pressure waves generated by detonating the one or more first and second shaped charges within a central bore of the connector defined by the inner surface.

17. The method of claim 16, wherein a diameter of the central bore varies along an axial length of the connector.

18. The method of claim 16, wherein the inner surface is tapered.

19. The method of claim 16, wherein the perforating gun string further comprises a tubing passing axially through the central bore, wherein the detonation cord passes axially through the tubing.

20. The method of claim 16, wherein the perforating gun string further comprises a plug contained within the central bore, the plug having a central passageway defined therethrough, wherein the detonation cord passes axially through the central passageway.

* * * * *